US010233785B1

(12) United States Patent
Lee et al.

(10) Patent No.: US 10,233,785 B1
(45) Date of Patent: Mar. 19, 2019

(54) STEAM TURBINE POWER GENERATION SYSTEM

(71) Applicant: KOREA INSTITUTE OF ENERGY RESEARCH, Daejeon (KR)

(72) Inventors: Gil Bong Lee, Seoul (KR); Beom Joon Lee, Daejeon (KR); Chul Woo Roh, Sejong-si (KR); Ho Sang Ra, Daejeon (KR); Young Jin Baik, Daejeon (KR)

(73) Assignee: KOREA INSTITUTE OF ENERGY RESEARCH, Daejeon (KR)

( * ) Notice: Subject to any disclaimer, the term of this patent is extended or adjusted under 35 U.S.C. 154(b) by 0 days.

(21) Appl. No.: 15/689,575

(22) Filed: Aug. 29, 2017

(51) Int. Cl.

| | |
|---|---|
| ***F25B 41/00*** | (2006.01) |
| ***F01K 9/00*** | (2006.01) |
| ***F01K 7/16*** | (2006.01) |
| ***F01K 11/02*** | (2006.01) |
| ***F28B 1/02*** | (2006.01) |
| ***F25B 41/04*** | (2006.01) |

(52) U.S. Cl.
CPC ..... *F01K 9/003* (2013.01); *F01K 7/16* (2013.01); *F01K 11/02* (2013.01); *F25B 41/00* (2013.01); *F25B 41/04* (2013.01); *F28B 1/02* (2013.01); *F25B 2341/001* (2013.01)

(58) Field of Classification Search
CPC .. F01K 17/005; F25B 1/06; F25B 1/08; F25B 1/10; F25B 2341/0012
See application file for complete search history.

(56) References Cited

U.S. PATENT DOCUMENTS

2003/0140651 A1* 7/2003 Takeuchi ..... F25B 1/08 62/500
2008/0087040 A1* 4/2008 Oshitani ..... F25B 41/00 62/500

FOREIGN PATENT DOCUMENTS

CN 202869080 * 4/2013
KR 10-1619135 B1 5/2016

* cited by examiner

*Primary Examiner* — Eric S Ruppert
(74) *Attorney, Agent, or Firm* — Birch, Stewart, Kolasch & Birch, LLP

(57) ABSTRACT

In a steam turbine power generation system according to the present invention, a regenerator and an ejector are selectively operated according to outdoor air temperature so that the effects of the outdoor air temperature can be minimized and thus an increase in back pressure of a turbine is prevented and thus the operating efficiency of the steam turbine power generation system can be guaranteed. In addition, when the outdoor air temperature is lower than a set temperature, only a steam condenser and an air cooling condenser are used, and when the outdoor air temperature is equal to or higher than the set temperature, the regenerator and the ejector are operated so that the condensation efficiency of the air cooling condenser is improved and thus the cooling efficiency of the steam turbine power generation system can be maximized.

15 Claims, 5 Drawing Sheets

STEAM TURBINE POWER GENERATION SYSTEM

BACKGROUND OF THE INVENTION

1. Field of the Invention

The present invention relates to a steam turbine power generation system, and more particularly, to a steam turbine power generation system, whereby a regenerator and an ejector are used so that the effects of outdoor temperature are minimized and thus the efficiency of the steam turbine power generation system can be further improved.

2. Description of the Related Art

In a power generation system using a steam turbine according to the related art, high-temperature steam exhausted from a turbine is cooled using a condenser.

When an air-cooling condenser that uses outdoor air so as to cool high-temperature steam exhausted from a turbine is used, the air-cooling condenser is greatly affected by the temperature of outdoor air. That is, when the outdoor air temperature rises to a set temperature or higher, condensation pressure of the condenser is increased so that a pressure difference between front and rear ends of the turbine is reduced. Thus, the performance of the turbine is lowered.

SUMMARY OF THE INVENTION

The present invention provides a steam turbine power generation system that is capable of minimizing the effects of outdoor air while using an air-cooling condenser.

According to an aspect of the present invention, there is provided a steam turbine power generation system including: a steam condenser configured to perform heat-exchanging high-temperature steam exhausted from a turbine with a heat-transfer fluid and to condense the steam; an air cooling condenser configured to perform heat-exchanging the heat-transfer fluid generated from the steam condenser with outdoor air and to condense the heat-transfer fluid; a regenerator configured to heat the heat-transfer fluid discharged after being condensed by the air cooling condenser using a heat source when temperature of the outdoor air is equal to or higher than a predetermined set temperature; an ejector configured to extract the heat-transfer fluid that passes through the steam condenser while intaking the heat-transfer fluid heated by the regenerator, and to inject the extracted heat-transfer fluid into the air cooling condenser; an air cooling condenser main discharge flow path configured to connect the air cooling condenser and the steam condenser and to guide at least a portion of the heat-transfer fluid discharged after being condensed by the air cooling condenser to the steam condenser; and an air cooling condenser auxiliary discharge flow path configured to connect the air cooling condenser and the regenerator and to guide the other portion of the heat-transfer fluid discharged after being condensed by the air cooling condenser to the regenerator when the temperature of the outdoor air is equal to or higher than the set temperature.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

Hereinafter, embodiments of the present invention will now be described with reference to the attached drawings.

Figure 1:
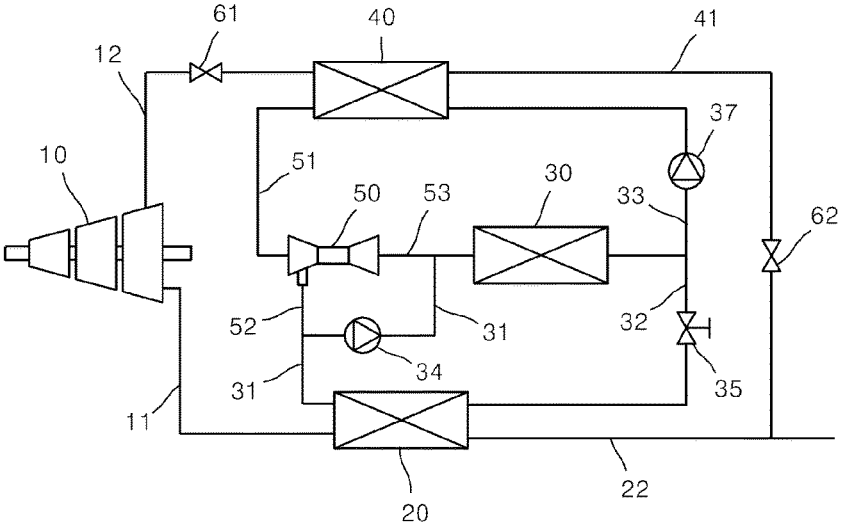
FIG. 1 is a view of a configuration of a steam turbine power generation system according to an embodiment of the present invention.

FIG. 1 is a view of a configuration of a steam turbine power generation system according to an embodiment of the present invention.

Referring to FIG. 1, the steam turbine power generation system according to an embodiment of the present invention includes a turbine 10, a steam condenser 20, an air-cooling condenser 30, a regenerator 40, and an ejector 50.

The case where the turbine 10 is a steam turbine, will now be described. The turbine 10 is coaxially connected to a power generator (not shown). Each of a turbine main discharge flow path 11 and a turbine auxiliary discharge flow path 12 is connected to the turbine 10. The turbine main discharge flow path 11 connects the turbine 10 to the steam condenser 20 so as to guide at least a portion of high-temperature steam exhausted from the turbine 10 to the steam condenser 20.

The turbine auxiliary discharge flow path 12 connects the turbine 10 to the regenerator 40 so as to guide the other portion of the high-temperature stream generated from the turbine 10 to the regenerator 40. The turbine auxiliary discharge flow path 12 is open only when the turbine 10 is in an overload state or the temperature of outdoor air is equal to or higher than a predetermined set temperature. A first opening/closing valve 61 that opens/closes a flow path is installed on the turbine auxiliary discharge flow path 12.

The steam condenser 20 is connected to the turbine 10 via the turbine main discharge flow path 11. The steam condenser 20 heat-exchanges the high-temperature steam exhausted from the turbine 10 with a heat-transfer fluid so as to condense the steam. The heat-transfer fluid is a heat-transfer fluid used in the air-cooling condenser 30, and this will be described in detail later. A steam condenser discharge flow path 22 that discharges steam heat-exchanged and condensed by the steam condenser 20 is connected to the steam condenser 20.

The air cooling condenser 30 is a heat exchanger that heat-exchanges the heat-transfer fluid that passes through the steam condenser 20 with outdoor air (hereinafter, referred to as outdoor air) and condenses the heat-transfer fluid. The air cooling condenser 30 and the steam condenser 20 form one cycle in which the heat-transfer fluid is circulated. Ammonia, carbon dioxide ($CO_2$), or the like may be used as the heat-transfer fluid.

An air cooling condenser intake flow path 31 is connected to an intake port of the air cooling condenser 30, and an air cooling condenser main discharge flow path 32 and an air cooling condenser auxiliary discharge flow path 33 are connected to a discharge port of the air cooling condenser 30.

The air cooling condenser intake flow path 31 connects the steam condenser 20 to the intake port of the air cooling condenser 30 so as to guide the heat-transfer fluid that passes through the steam condenser 20 to the air cooling condenser 30. The case where a blower 34 is installed on the air cooling condenser intake flow path 31, will now be described. However, embodiments of the present invention are not limited thereto, and instead of the blower 34, fluid machinery having a comparatively small pressure ratio may also be installed.

The air cooling condenser main discharge flow path 32 connects the discharge port of the air cooling condenser 30 to the steam condenser 20. The air cooling condenser main discharge flow path 32 guides at least a portion of the heat-transfer fluid discharged after being condensed by the air cooling condenser 30 to the steam condenser 20. A flow control valve 35 is installed on the air cooling condenser main discharge flow path 32.

The flow control valve 35 is installed on the air cooling condenser main discharge flow path 32 and controls the flow of the heat-transfer fluid discharged through the air cooling condenser main discharge flow path 32. That is, the flow control valve 35 controls the flow of the heat-transfer fluid in such a way that, when the outdoor air temperature is lower than the set temperature, the whole of the heat-transfer fluid generated from the air cooling condenser 30 is discharged via the air cooling condenser main discharge flow path 32, and when the outdoor air temperature is equal to or higher than the set temperature, only at least a portion of the heat-transfer fluid generated from the air cooling condenser 30 is discharged via the air cooling condenser main discharge flow path 32.

The air cooling condenser auxiliary discharge flow path 33 connects the discharge port of the air cooling condenser 30 to the regenerator 40. The air cooling condenser auxiliary discharge flow path 33 guides the remainder of the heat-transfer fluid discharged after being condensed by the air cooling condenser 30 to the regenerator 40. The case where the air cooling condenser auxiliary discharge flow path 33 is diverged from the air cooling condenser main discharge flow path 32, will be described. A pump 36 is installed on the air cooling condenser auxiliary discharge flow path 33. The pump 36 pumps the heat-transfer fluid discharged via the air cooling condenser auxiliary discharge flow path when the outdoor air temperature is equal to or higher than the set temperature.

When the outdoor air temperature is equal to or higher than the set temperature, the regenerator 40 heats the heat-transfer fluid discharged after being condensed by the air cooling condenser 30 using a heat source. In the current embodiment, the case where the heat source is high-temperature steam exhausted from the turbine 10, will be described. However, embodiments of the preset invention are not limited thereto, and other additional heat sources as well as the high-temperature steam may also be used. Heat-exchanging of the heat-transfer fluid and the steam is performed in the regenerator 40. An intake port of the regenerator 40 is connected to the turbine auxiliary discharge flow path 12, and a regenerator steam discharge flow path 41 is connected to a discharge port of the regenerator 40.

The regenerator steam discharge flow path 41 is connected to the steam condenser discharge flow path 22. A second opening/closing valve 62 that opens/closes the flow path is installed on the regenerator steam discharge flow path 41.

The ejector 50 is installed on a flow path that connects the regenerator 40 and the air cooling condenser 30. The ejector 50 extracts the heat-transfer fluid that passes through the steam condenser 20 while intaking the heat-transfer fluid heated by the regenerator 40, and injects the extracted heat-transfer fluid into the air cooling condenser 30. The ejector 50 includes a main intake port, an auxiliary intake port, and an injection port. An ejector main intake flow path 51 is connected to the main intake port of the ejector 50. An ejector auxiliary intake flow path 52 is connected to the auxiliary intake port of the ejector 50. An ejector injection flow path 53 is connected to the injection port of the ejector 50. The ejector auxiliary intake flow path 52 is diverged from the air cooling condenser intake flow path 31.

Also, the steam turbine power generation system further includes a control unit (not shown) that controls operations of the first opening/closing valve 61, the second opening/closing valve 62, the flow control valve 35, the pump 37, and the blower 34 according to the temperature of outdoor air.

The operation of the steam turbine power generation system having the above configuration according to an embodiment of the present invention will be described as follows. First, the case where the temperature of outdoor air that will be heat-exchanged with the heat-transfer fluid using the air cooling condenser 30 is lower than the predetermined set temperature, will be described.

Figure 2:
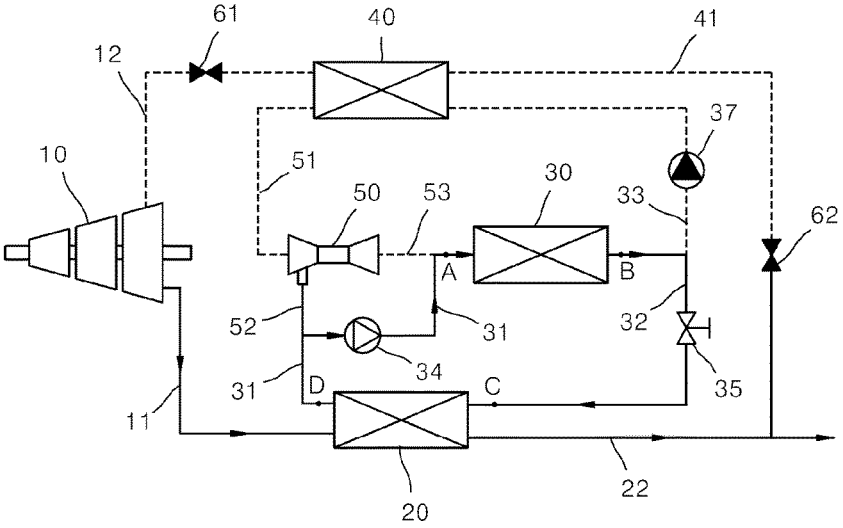
FIG. 2 is a view of an operation of the steam turbine power generation system illustrated in FIG. 1 when outdoor air temperature is lower than a set temperature.
Figure 3:
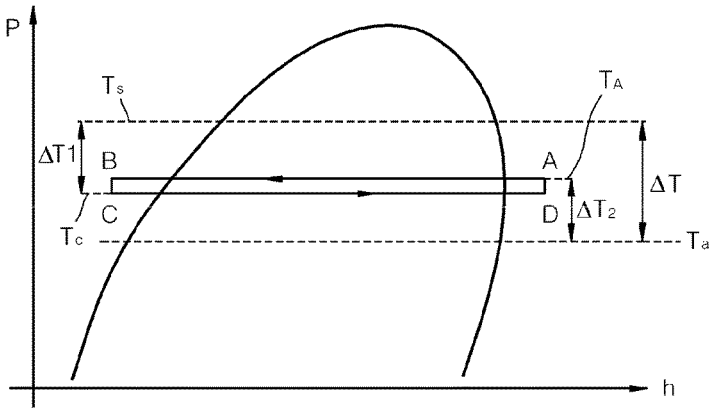
FIG. 3 is a P-h diagram view showing an operating state illustrated in FIG. 2.

FIG. 2 is a view of an operation of the steam turbine power generation system illustrated in FIG. 1 when outdoor air temperature is lower than a set temperature. FIG. 3 is a P-h diagram view showing an operating state illustrated in FIG. 2.

As illustrated in FIGS. 2 and 3, when the temperature of outdoor air is lower than the predetermined set temperature, the steam turbine power generation system performs a normal operation.

When the normal operation is performed, the control unit (not shown) stops operations of the regenerator 40 and the ejector 50. The control unit (not shown) closes the first opening/closing valve 61 and stops the operation of the pump 37.

Thus, when the normal operation is performed, the high-temperature steam exhausted from the turbine 10 passes through the steam condenser 20, and the heat-transfer fluid is circulated throughout the steam condenser 20 and the air cooling condenser 30.

Heat-exchanging of the high-temperature steam and the heat-transfer fluid is performed by the steam condenser 20. The high-temperature steam is cooled and condensed, and the heat-transfer fluid is heated and evaporated by the steam condenser 20.

Referring to FIG. 3, the heat-transfer fluid intaked into the steam condenser 20 is in a medium-temperature low-pressure liquid state C condensed by the air cooling condenser 30. The heat-transfer fluid discharged from the steam condenser 20 is evaporated by the high-temperature steam and is in a gaseous state D. That is, in FIG. 3, C-D represents an evaporation procedure of the heat-transfer fluid.

In FIG. 3, $T_s$ represents temperature of steam exhausted from the turbine 10 and supplied to the steam condenser 20.

$\Delta T_1$ represents a difference $\Delta T_1$ between temperature $T_s$ of the steam supplied to the steam condenser 20 and temperature $T_c$ of the heat-transfer fluid in the liquid state C intaked into the steam condenser 20. By using the steam condenser 20, the steam is cooled ad condensed according to the difference $\Delta T_1$ of the temperature, and the heat-transfer fluid is heated.

The heat-transfer fluid heat-exchanged and evaporated by the steam condenser 20 is intaked into the air cooling condenser 30 via the air cooling condenser intake flow path 31. By using the air cooling condenser 30, heat-exchanging of the heat-transfer fluid generated from the steam condenser 20 and the outdoor air is performed. By using the air cooling condenser 30, the heat-transfer fluid is cooled and condensed, and the outdoor air is heated and evaporated.

Referring to FIG. 3, the heat-transfer fluid intaked into the air cooling condenser 30 is in a gaseous state A. The heat-transfer fluid discharged from the air cooling condenser 30 is condensed by heat-exchanging with the outdoor air and is in a medium-temperature and low-pressure liquid state B. In FIG. 3, A-B represents a condensation procedure of the heat-transfer fluid.

In FIG. 3, $T_a$ represents the temperature of the outdoor air. $\Delta T_2$ represents a difference $\Delta T_2$ between temperature $T_a$ of the outdoor air supplied to the air cooling condenser 30 and temperature $T_A$ of the heat-transfer fluid in the gaseous state A intaked into the air cooling condenser 30. By using the air cooling condenser 30, the heat-transfer fluid is cooled and condensed according to the difference $\Delta T_2$ of the temperature.

Meanwhile, the case where the temperature of the outdoor air heat-exchanged with the heat-transfer fluid by using the air cooling condenser 30 is equal to or higher than the predetermined set temperature, will be descried. When the ejector 50 and the regenerator 40 are not used, if the temperature of the outdoor air is equal to or higher than the set temperature and is too high, heat-exchanging is not efficiently performed in the air cooling condenser 30, and a condensation pressure of the steam condenser 20 is increased, and the pressure of a rear end of the turbine 10 is increased so that the performance of the steam turbine power generation system may be decreased. In the current embodiment, the ejector 50 and the regenerator 40 are used so that heat-exchanging efficiency in the air cooling condenser 30 is improved and the condensation pressure of the steam condenser 20 can be prevented from being increased.

Figure 4:
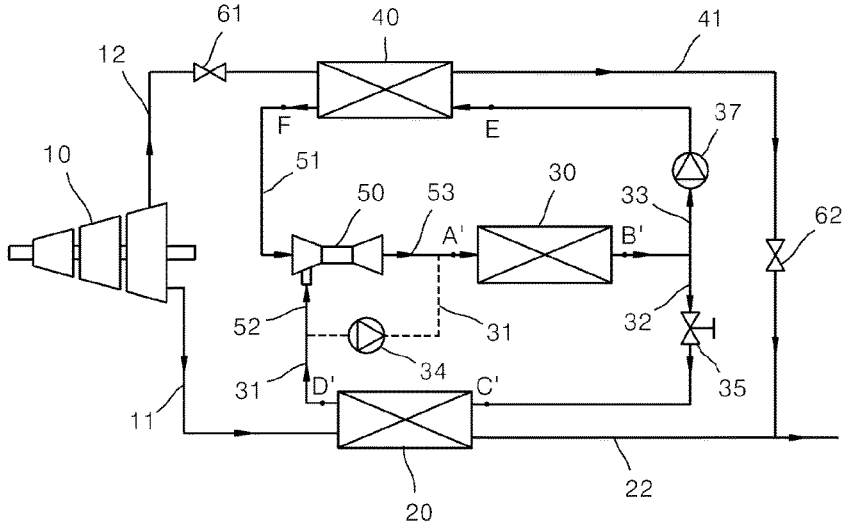
FIG. 4 illustrates an operation of the steam turbine power generation system illustrated in FIG. 1 when the outdoor air temperature is equal to or higher than a set temperature.
Figure 5:
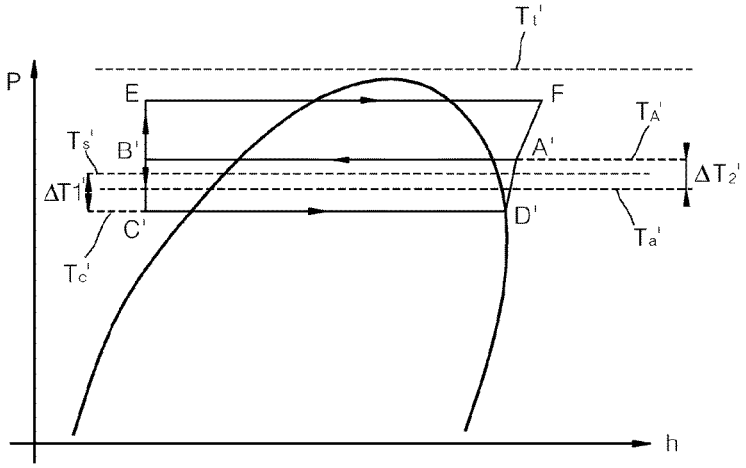
FIG. 5 is a P-h diagram view showing an operating state illustrated in FIG. 4.

FIG. 4 illustrates an operation of the steam turbine power generation system illustrated in FIG. 1 when the outdoor air temperature is equal to or higher than a set temperature. FIG. 5 is a P-h diagram view showing an operating state illustrated in FIG. 4.

As illustrated in FIGS. 4 and 5, when the temperature of the outdoor air is equal to or higher than the set temperature, the steam turbine power generation system performs an outdoor air high-temperature operation. When the outdoor air high-temperature operation is performed, the control unit (not shown) operates the regenerator 40 and the ejector 50. Also, the control unit (not shown) opens the first opening/closing valve 61 and also operates the pump 37. When the outdoor air high-temperature operation is performed, a portion of the high-temperature steam exhausted from the turbine 10 is supplied to the steam condenser 20, and the other portion thereof is supplied to the regenerator 40. In this case, temperature $T_t'$ of steam supplied from the turbine 10 to the regenerator 40 is higher than temperature $T_s'$ of steam supplied to the steam condenser 20.

By using the steam condenser 20, heat-exchanging of the high-temperature steam and the heat-transfer fluid is performed. By using the steam condenser 20, the high-temperature steam is cooled and condensed, and the heat-transfer fluid is heated and evaporated.

Referring to FIG. 4, the heat-transfer fluid intaked into the steam condenser 20 is in a medium-temperature and low-pressure liquid state C' condensed by the air cooling condenser 30, and the heat-transfer fluid discharged from the steam condenser 20 is evaporated by the high-temperature steam and is in a gaseous state D'. That is, in FIG. 5, C'-D' represents an evaporation procedure of the heat-transfer fluid.

In FIG. 5, $T_s'$ is the temperature of steam supplied from the turbine 10 to the steam condenser 20, and $T_t'$ is the temperature of steam supplied from the turbine 10 to the regenerator 40. $\Delta T_1'$ represents a difference $\Delta T_1'$ between temperature $T_s'$ of the steam supplied to the steam condenser 20 and temperature $T_c'$ of the heat-transfer fluid in the liquid state C' intaked into the steam condenser 20. By using the steam condenser 20, the steam is cooled and condensed according to the difference $\Delta T_1'$ of the temperature, and the heat-transfer fluid is heated and evaporated.

The heat-transfer fluid heat-exchanged and evaporated by the steam condenser 20 is intaked into the air cooling condenser 30 via the ejector 50. By using the air cooling condenser 30, heat-exchanging of the heat-transfer fluid injected by the ejector 50 and the outdoor air is performed. By using the air cooling condenser 30, the heat-transfer fluid is cooled and condensed, and the outdoor air is heated.

Referring to FIG. 5, the heat-transfer fluid intaked into the air cooling condenser 30 is in a gaseous state A', and the heat-transfer fluid that passes through the air cooling condenser 30 is condensed through heat-exchanging with the outdoor air and is in a medium-temperature low-pressure liquid state B'. That is, in FIG. 5, A'-B' represents a condensation procedure of the heat-transfer fluid.

In FIG. 5, Ta' represents the temperature of the outdoor air. $\Delta T2'$ represents a difference $\Delta T2'$ between the temperature Ta' of the outdoor air supplied to the air cooling condenser 30 and the temperature $T_A'$ of the heat-transfer fluid in the gaseous state A' intaked into the air cooling condenser 30. By using the air cooling condenser 30, the heat-transfer fluid is cooled and condensed according to the difference $\Delta T2'$ of the temperature.

By using the air cooling condenser 30, at least a portion of the discharged heat-transfer fluid is supplied to the steam condenser 20, and the other portion thereof is supplied to the regenerator 40. The heat-transfer fluid discharged from the air cooling condenser 30 via the air cooling condenser auxiliary discharge flow path 33 is in a medium-temperature low-pressure liquid state, passes through the pump 37 and is in a medium-temperature high-pressure liquid state E. That is, the heat-transfer fluid intaked into the regenerator 40 is in the medium-temperature high-pressure liquid state E.

By using the regenerator 40, heat-exchanging between the high-temperature steam exhausted from the turbine 10 and the heat-transfer fluid is performed. By using the regenerator 40, the high-temperature steam is cooled and condensed, and the heat-transfer fluid is heated and evaporated.

Referring to FIG. 5, the heat-transfer fluid intaked into the regenerator 40 is in the medium-temperature high-pressure liquid state E, passes through the regenerator 40, is evaporated and is in a gaseous state F. That is, in FIG. 5, E-F represents an evaporation procedure of the heat-transfer fluid.

The heat-transfer fluid in the gaseous state evaporated by the regenerator 40 is injected into the air cooling condenser 30 via the ejector 50.

When the outdoor temperature is equal to or higher than the set temperature, as described above, the regenerator 40 and the ejector 50 are used so that the heat-exchanging efficiency of the outdoor air and the heat-transfer fluid in the air cooling condenser 30 can be guaranteed. Also, because the heat-transfer fluid is sufficiently cooled and condensed by the air cooling condenser 30 and then is supplied to the steam condenser 20, the evaporation temperature of the heat-transfer fluid may be lowered. Thus, by using the steam condenser 20, the high-temperature steam can be sufficiently cooled and condensed.

Thus, even when the outdoor air temperature is equal to or higher than the set temperature and there is a small difference between a steam temperature Ts' of the steam condenser 20 and the outdoor air temperature, the steam can be sufficiently cooled so that the condensation pressure of the steam condenser 20 can be prevented from being increased and an increase of back pressure of the turbine 10 can be prevented and thus, an operation loss caused thereby can be reduced.

Figure 6:
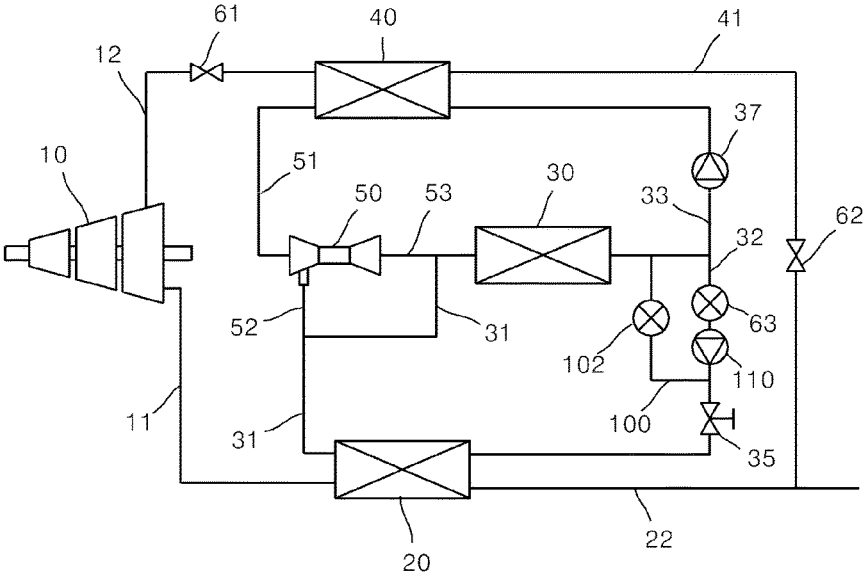
FIG. 6 is a view of a configuration of a steam turbine power generation system according to another embodiment of the present invention.

FIG. 6 is a view of a configuration of a steam turbine power generation system according to another embodiment of the present invention.

Referring to FIG. 6, the steam turbine power generation system according to another embodiment of the present invention further includes a bypass flow path 100 diverged from the air cooling condenser main discharge flow path 32, a bypass valve 102 installed on the bypass flow path 100, a first pump 62 installed on the air cooling condenser auxiliary discharge flow path 33, a second pump 110 installed on the air cooling condenser main discharge flow path 32, and a third opening/closing valve 63 installed on the air cooling condenser main discharge flow path 32. Thus, the current embodiment is different from the above-described one embodiment in that the heat-transfer fluid that is circulated throughout the steam condenser 20 and the air cooling condenser 30 is circulated using the second pump 110, and the other configuration thereof is similar to that of the one embodiment. Thus, like reference numerals are used for a similar configuration, and detailed descriptions of the similar configuration will be omitted.

The bypass flow path 100 is diverged from the air cooling condenser main discharge flow path 32, and the heat-transfer fluid condensed by the air cooling condenser 30 bypasses the second pump 110.

Only when the temperature of the outdoor air is equal to or higher than the set temperature, the bypass valve 102 opens the bypass flow path 100, and when the temperature of the outdoor air is lower than the set temperature, the bypass valve 102 closes the bypass flow path 100.

The second pump 110 pumps the heat-transfer fluid condensed by the air cooling condenser 30 to supply the heat-transfer fluid to the steam condenser 20.

Figure 7:
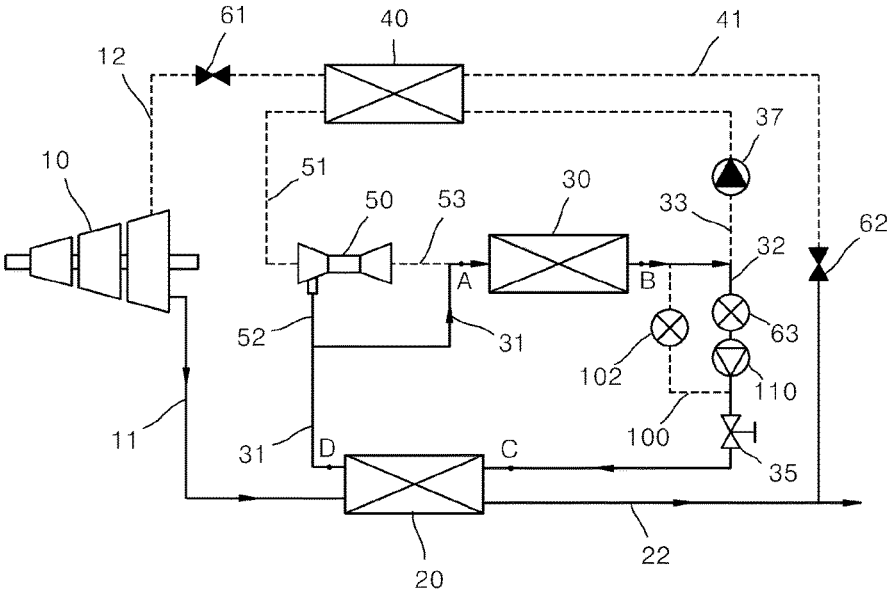
FIG. 7 is a view of an operation of the steam turbine power generation system illustrated in FIG. 6 when outdoor air temperature is lower than a set temperature.

FIG. 7 is a view of an operation of the steam turbine power generation system illustrated in FIG. 6 when the outdoor air temperature is lower than the set temperature.

Referring to FIG. 7, when the temperature of the outdoor air is lower than the predetermined set temperature, the steam turbine power generation system performs a normal operation.

When the normal operation is performed, the control unit (not shown) stops operations of the regenerator 40 and the ejector 50. The control unit (not shown) closes the first opening/closing valve 61 and the bypass valve 102 and also stops the operation of the first pump 62.

Thus, when the normal operation is performed, high-temperature steam exhausted from the turbine 10 passes through the steam condenser 20, and the heat-transfer fluid is circulated throughout the steam condenser 20 and the air cooling condenser 30.

By using the steam condenser 20, heat-exchanging of the high-temperature steam and the heat-transfer fluid is performed. By using the steam condenser 20, the high-temperature steam is cooled and condensed, and the heat-transfer fluid is heated and evaporated.

The heat-transfer fluid heat-exchanged and evaporated by the steam condenser 20 is intaked into the air cooling condenser 30 via the air cooling condenser intake flow path 31.

By using the air cooling condenser 30, heat-exchanging of the heat-transfer fluid generated from the steam condenser 20 and the outdoor air is performed. By using the air cooling condenser 30, the heat-transfer fluid is cooled and condensed, and the outdoor air is heated and evaporated.

The heat-transfer fluid condensed by the air cooling condenser 30 is pumped by the second pump 110 and is supplied to the steam condenser 20. Because the heat-transfer fluid condensed by the air cooling condenser 30 is in a liquid state, the heat-transfer fluid is pumped by the second pump 110.

Figure 8:
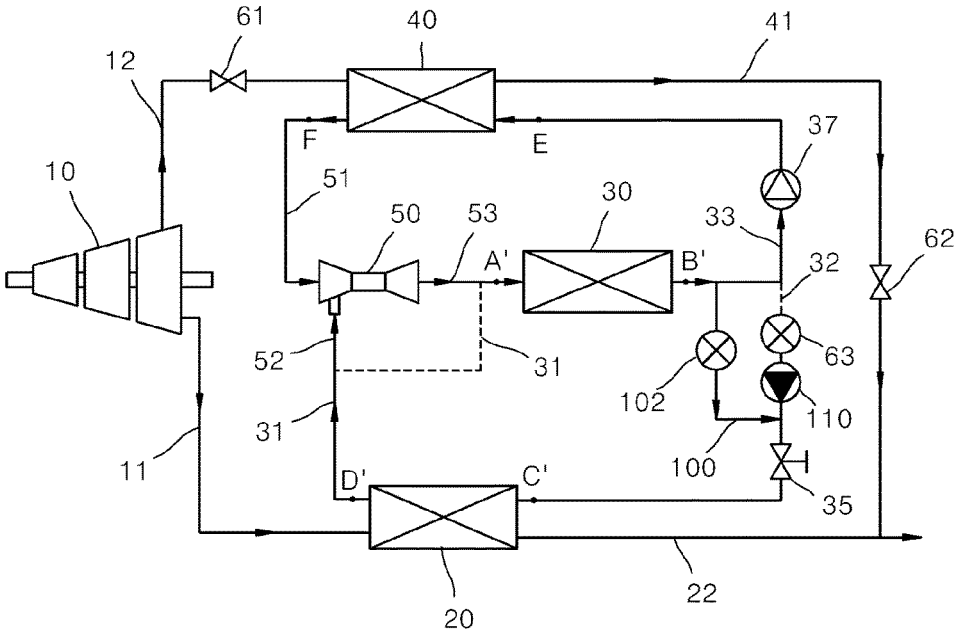
FIG. 8 illustrates an operation of the steam turbine power generation system illustrated in FIG. 6 when the outdoor air temperature is equal to or higher than a set temperature.

FIG. 8 illustrates an operation of the steam turbine power generation system illustrated in FIG. 6 when the outdoor air temperature is equal to or higher than a set temperature.

Referring to FIG. 8, when the temperature of the outdoor air heat-exchanged by the air cooling condenser 30 is equal to or higher than the set temperature, the steam turbine power generation system performs an outdoor air high-temperature operation.

When the outdoor air high-temperature operation is performed, the control unit (not shown) operates the regenerator 40 and the ejector 50. Also, the control unit (not shown) opens the first opening/closing valve 61 and the bypass valve 102 and closes the third opening/closing valve 63. Also, the control unit (not shown) also operates the first pump 37 and stops the operation of the second pump 110.

When the outdoor air high-temperature operation is performed, a portion of the high-temperature steam exhausted from the turbine 10 is supplied to the steam condenser 20, and the other portion thereof is supplied to the regenerator 40. In this case, the temperature of the steam supplied from the turbine 10 to the regenerator 40 is higher than the temperature of the steam supplied to the steam condenser 20.

By using the steam condenser 20, heat-exchanging of the high-temperature steam and the heat-transfer fluid is performed. By using the steam condenser 20, the high-temperature steam is cooled and condensed, and the heat-transfer fluid is heated and evaporated. The heat-transfer fluid heat-exchanged and evaporated in the steam condenser 20 is intaked into the air cooling condenser 30 via the ejector 50.

By using the air cooling condenser 30, heat-exchanging of the heat-transfer fluid generated from the steam condenser 20 and the outdoor air is performed.

At least a portion of the heat-transfer fluid discharged from the air cooling condenser 30 is supplied to the steam condenser 20, and the other portion thereof is supplied to the regenerator 40 via the first pump 37. The heat-transfer fluid discharged from the air cooling condenser 30 through the air cooling condenser auxiliary discharge flow path 33 is in a medium-temperature low-pressure liquid state, passes through the pump 37 and is in a medium-temperature high-pressure liquid state. That is, the heat-transfer fluid intaked into the regenerator 40 is in the medium-temperature high-pressure liquid state.

At least a portion of the heat-transfer fluid discharged from the air cooling condenser 30 is supplied to the steam condenser 20 through the bypass flow path 100.

By using the regenerator 40, heat-exchanging of the high-temperature steam exhausted from the turbine 10 and the heat-transfer fluid is performed. By using the regenerator 40, the high-temperature steam is cooled and condensed, and the heat-transfer fluid is heated and evaporated.

The heat-transfer fluid in the gaseous state evaporated by the regenerator 40 is injected into the air cooling condenser 30 via the ejector 50.

When the outdoor air temperature is equal to or higher than the set temperature, as described above, the operation of the second pump 110 may be stopped, and the heat-transfer fluid generated from the air cooling condenser 30 may be supplied to the steam condenser 20 through the bypass flow path 100.

As described above, in a steam turbine power generation system according to the present invention, a regenerator and an ejector are selectively operated according to outdoor air temperature so that the effects of the outdoor air temperature can be minimized and thus an increase in back pressure of a turbine is prevented and thus the operating efficiency of the steam turbine power generation system can be guaranteed.

In addition, when the outdoor air temperature is lower than a set temperature, only a steam condenser and an air cooling condenser are used, and when the outdoor air temperature is equal to or higher than the set temperature, the regenerator and the ejector are operated so that the condensation efficiency of the air cooling condenser is improved and thus the cooling efficiency of the steam turbine power generation system can be maximized.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A steam turbine power generation system comprising:

a steam condenser configured to perform heat-exchanging high-temperature steam exhausted from a turbine with a heat-transfer fluid and to condense the steam;

an air cooling condenser configured to heat-exchange the heat-transfer fluid generated from the steam condenser with outdoor air and to condense the heat-transfer fluid;

a regenerator configured to heat the heat-transfer fluid discharged after being condensed by the air cooling condenser using a heat source when a temperature of the outdoor air is equal to or higher than a predetermined set temperature;

an ejector configured to extract the heat-transfer fluid that passes through the steam condenser while intaking the heat-transfer fluid heated by the regenerator, and to inject the extracted heat-transfer fluid into the air cooling condenser;

an air cooling condenser main discharge flow path configured to connect the air cooling condenser and the steam condenser and to guide at least a first portion of the heat-transfer fluid discharged after being condensed by the air cooling condenser to the steam condenser;

an air cooling condenser auxiliary discharge flow path configured to connect the air cooling condenser and the regenerator and to guide a second portion of the heat-transfer fluid discharged after being condensed by the air cooling condenser to the regenerator when the temperature of the outdoor air is equal to or higher than the set temperature;

a pump installed on the air cooling condenser auxiliary discharge flow path and configured to pump the heat-transfer fluid so as to be discharged through the air cooling condenser auxiliary discharge flow path;

an opening/closing valve provided between the turbine and the regenerator; and a controller configured to:

stop operation of the regenerator and the ejector when the temperature of outdoor air is lower than the set temperature by closing the opening/closing valve and stopping operation of the pump; and start operation of the regenerator and the ejector when the temperature of outdoor air is higher than the set temperature by opening the opening/closing valve and starting operation of the pump.

2. The steam turbine power generation system of claim 1, further comprising an air cooling condenser intake flow path configured to connect the steam condenser and the air cooling condenser and to guide the heat-transfer fluid evaporated by the steam condenser to the air cooling condenser when the temperature of the outdoor air is lower than the set temperature.

3. The steam turbine power generation system of claim 2, further comprising a blower installed on the air cooling condenser intake flow path.

4. The steam turbine power generation system of claim 1, further comprising an ejector auxiliary intake flow path configured to connect the steam condenser and the ejector and to guide the heat-transfer fluid evaporated by the steam condenser to the ejector when the temperature of the outdoor air is equal to or higher than the set temperature.

5. The steam turbine power generation system of claim 2, further comprising an ejector auxiliary intake flow path diverged from the air cooling condenser intake flow path, connected to the ejector and configured to guide the heat-transfer fluid evaporated by the steam condenser to be intaked into the ejector when the temperature of the outdoor air is equal to or higher than the set temperature.

6. The steam turbine power generation system of claim 1, further comprising a flow control valve installed on the air cooling condenser main discharge flow path and controlling a flow of the heat-transfer fluid discharged through the air cooling condenser main discharge flow path.

7. The steam turbine power generation system of claim 1, wherein the regenerator evaporates the heat-transfer fluid discharged after being condensed by the air cooling condenser using the high-temperature steam exhausted from the turbine.

8. The steam turbine power generation system of claim 7, further comprising a turbine main discharge flow path configured to connect the turbine and the steam condenser and to guide a first portion of the high-temperature steam exhausted from the turbine to the steam condenser.

9. The steam turbine power generation system of claim 8, further comprising a turbine auxiliary discharge flow path configured to connect the turbine and the regenerator and to guide a second portion of the high-temperature steam exhausted from the turbine to the regenerator when the temperature of the outdoor air is equal to or higher than the set temperature.

10. The steam turbine power generation system of claim 7, further comprising:

a regenerator steam discharge flow path connected to the regenerator and configured to discharge the steam discharged after being heat-exchanged by the regenerator; and a steam condenser discharge flow path connected to the steam condenser and configured to discharge the steam discharged after being heat-exchanged by the steam condenser, wherein the steam condenser discharge flow path is connected to the regenerator steam discharge flow path.

11. The steam turbine power generation system of claim 1, further comprising a second pump installed on the air cooling condenser main discharge flow path and configured to pump the heat-transfer fluid so as to be discharged through the air cooling condenser main discharge flow path.

12. The steam turbine power generation system of claim 11, further comprising a bypass flow path, which is diverged from the air cooling condenser main discharge flow path and through which the heat-transfer fluid discharged from the air cooling condenser bypasses the second pump.

13. The steam turbine power generation system of claim 12, further comprising a bypass valve installed on the bypass flow path and configured to open the bypass flow path when the temperature of the outdoor air is equal to or higher than the set temperature.

14. The steam turbine power generation system of claim 12, further comprising a second opening/closing valve installed on the air cooling condenser main discharge flow path and configured to open the air cooling condenser main discharge flow path when the temperature of the outdoor air is lower than the set temperature.

15. A steam turbine power generation system comprising:

a steam condenser configured to heat-exchange high-temperature steam exhausted from a turbine with a heat-transfer fluid and to condense the steam;

an air cooling condenser configured to perform heat-exchanging the heat-transfer fluid generated from the steam condenser with outdoor air and to condense the heat-transfer fluid;

a regenerator configured to heat the heat-transfer fluid discharged after being condensed by the air cooling condenser using the high-temperature steam exhausted from the turbine;

an ejector configured to extract the heat-transfer fluid that passes through the steam condenser while intaking the heat-transfer fluid heated by the regenerator, and to inject the extracted heat-transfer fluid into the air cooling condenser;

an air cooling condenser main discharge flow path configured to connect the air cooling condenser and the steam condenser and to guide at least a first portion of the heat-transfer fluid discharged after being condensed by the air cooling condenser to the steam condenser;

an air cooling condenser auxiliary discharge flow path configured to connect the air cooling condenser and the regenerator and to guide a second portion of the heat-transfer fluid discharged after being condensed by the air cooling condenser to the regenerator when the temperature of the outdoor air is equal to or higher than the set temperature;

an air cooling condenser intake flow path configured to connect the steam condenser and the air cooling condenser and to guide the heat-transfer fluid evaporated by the steam condenser to the air cooling condenser when the temperature of the outdoor air is lower than the set temperature;

a blower installed on the air cooling condenser intake flow path;

an ejector auxiliary intake flow path diverged from the air cooling condenser intake flow path, connected to the ejector, and configured to guide the heat-transfer fluid evaporated by the steam condenser to the ejector when the temperature of the outdoor air is equal to or higher than the set temperature;

a flow control valve installed on the air cooling condenser main discharge flow path and controlling a flow of the heat-transfer fluid discharged through the air cooling condenser main discharge flow path;

a pump installed on the air cooling condenser auxiliary discharge flow path and configured to pump the heat-transfer fluid so as to be discharged through the air cooling condenser auxiliary discharge flow path when the temperature of the outdoor air is equal to or higher than the set temperature;

an opening/closing valve provided between the turbine and the regenerator; and a controller configured to:

stop operation of the regenerator and the ejector when the temperature of outdoor air is lower than the set temperature by closing the opening/closing valve and stopping operation of the pump; and start operation of the regenerator and the ejector when the temperature of outdoor air is higher than the set temperature by opening the opening/closing valve and starting operation of the pump.

* * * * *